United States Patent [19]

Waterstrat

[11] Patent Number: 4,627,482

[45] Date of Patent: Dec. 9, 1986

[54] ARC-FURNACE FOR THE PRODUCTION OF SMALL INVESTMENT CASTINGS OF REACTIVE OR REFRACTORY METALS SUCH AS TITANIUM

[75] Inventor: Richard M. Waterstrat, Gaithersburg, Md.

[73] Assignee: American Dental Association Health Foundation, Washington, D.C.

[21] Appl. No.: 698,268

[22] Filed: Feb. 5, 1985

Related U.S. Application Data

[63] Continuation of Ser. No. 258,673, Apr. 29, 1981, abandoned.

[51] Int. Cl.[4] ..... B22D 23/00

[52] U.S. Cl. ..... 164/514; 164/253; 164/259; 164/337; 164/342

[58] Field of Search ..... 164/259, 342, 457, 458, 164/495, 496, 497, 514, 515, 337, 253

[56] References Cited

U.S. PATENT DOCUMENTS

| | | | |
|---|---|---|---|
| 3,599,707 | 8/1971 | Lauzier | 164/342 |
| 3,682,458 | 8/1972 | Piwonka et al. | 164/133 |
| 3,946,907 | 3/1976 | Berve | 164/61 |
| 3,955,612 | 5/1976 | Schultheiss | 164/62 |
| 4,150,707 | 4/1979 | Emerick | 164/495 |
| 4,424,853 | 1/1984 | Khandros et al. | 164/66.1 |

FOREIGN PATENT DOCUMENTS

| | | | |
|---|---|---|---|
| 54-109028 | 8/1979 | Japan | 164/514 |

OTHER PUBLICATIONS

Ida et al., "A New Dental Casting Machine Utilizing Argon Arc Fusing . . . ", 9/1979.

Hepworth, *Journal of Metals,* 14, Jun. '62, p. 411.

Crow et al., *Rev. of Scientific Instr.,* 44, 1973, p. 1398.

IADR Abstract No. 397 from 1980 IADR.

A. D. & M. K. McQuillan, "Titanium", Buttersworth, London, 1956, pp. 70–72.

*Primary Examiner*—Nicholas P. Godici

*Assistant Examiner*—Richard K. Seidel

*Attorney, Agent, or Firm*—Allegretti, Newitt, Witcoff & McAndrews, Ltd.

[57] ABSTRACT

An arc furnace and investment casting apparatus includes a copper base with an integrally formed crucible having a passage therethrough. A vacuum chamber is positioned on the top of the copper crucible with a non-consumable cathode projecting into the chamber to effect melting of metal placed in the crucible. A vacuum chamber is also suspended beneath the crucible for support of a mold to receive molten metal flowing through the passage.

3 Claims, 3 Drawing Figures

Fig. 1
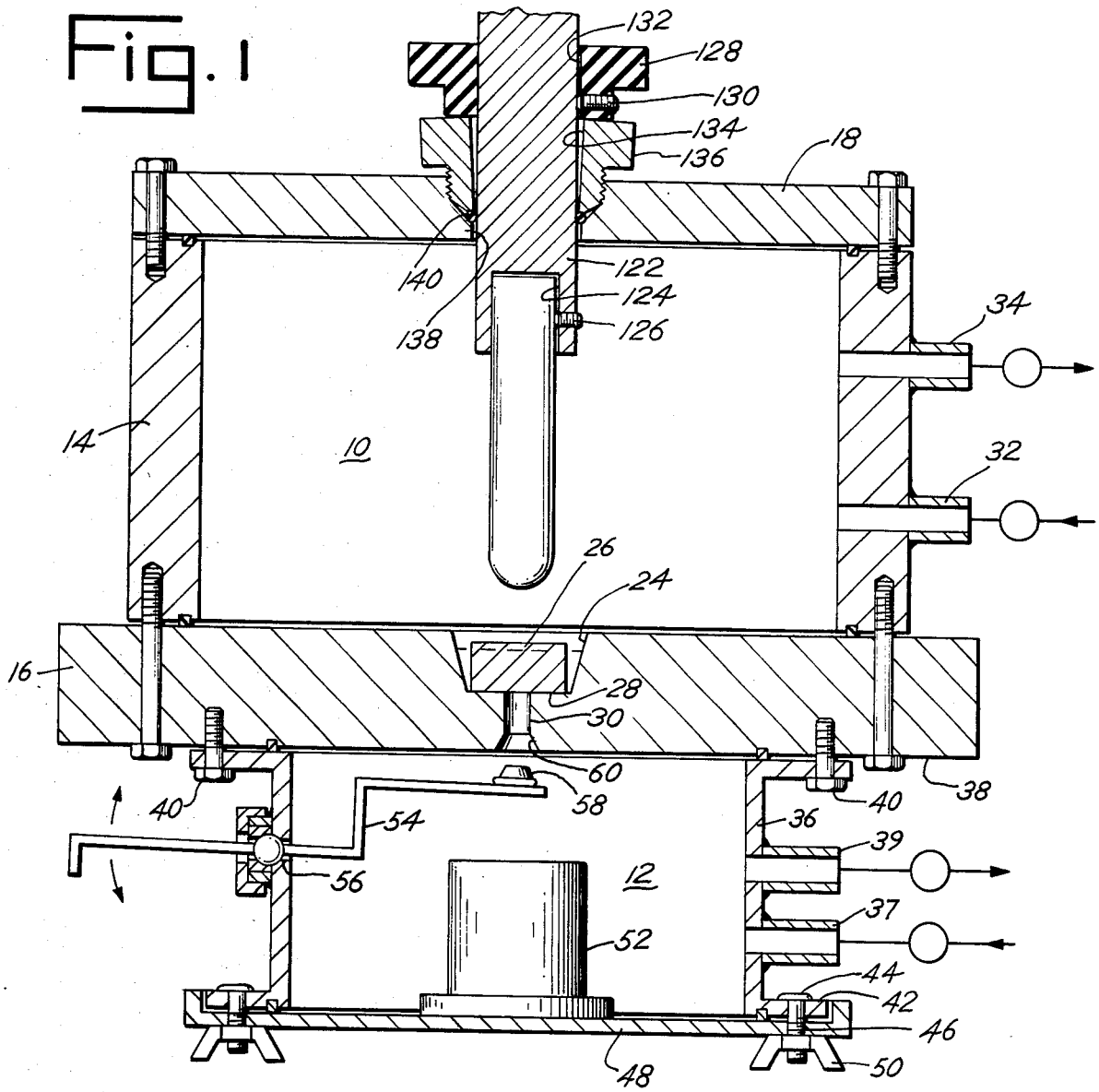
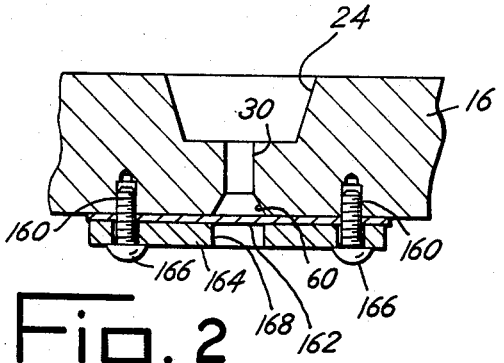
Fig. 2
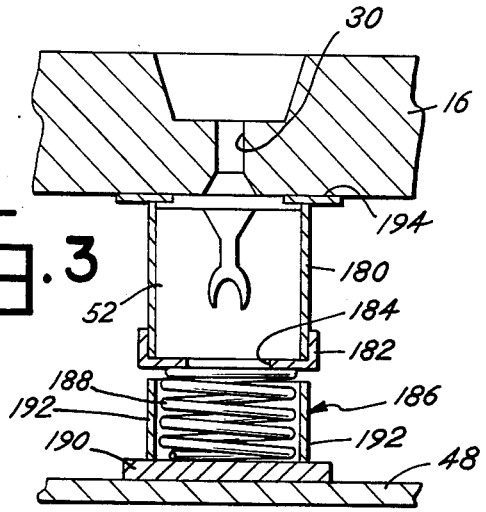
Fig. 3

ARC-FURNACE FOR THE PRODUCTION OF SMALL INVESTMENT CASTINGS OF REACTIVE OR REFRACTORY METALS SUCH AS TITANIUM

The invention described herein may be manufactured and used by or for the government of the United States of America for governmental purposes without the payment of any royalties thereon or therefor.

This is a continuation of application Ser. No. 258,673, filed Apr. 29, 1981 now abandoned.

BACKGROUND OF THE INVENTION

This invention relates to an improved arc-furnace and investment casting apparatus and more particularly to an apparatus ideally suited for casting reactive and relatively high melting point metals such as titanium.

Electric arc furnaces have been used for melting a variety of metals and alloys in order to prepare the material in the form of ingots or castings. Various advantages result from an arc melting process including the following:

1. Almost any metal can be quickly and easily melted including those that are chemically reactive and have very high melting points such as tungsten which has a melting temperature of about 3,400° C.

2. The melting may be done in an enclosed chamber containing an inert gas such as argon or helium which prevents contamination of the metal by atmospheric gases such as oxygen or nitrogen.

3. The molten metal may be held in a relatively non-reactive container thereby avoiding contamination which can be introduced if one were to use a graphite, refractory oxide or heated metallic crucible.

4. Power supplies and accessory equipment are relatively inexpensive.

Arc melting uses a non-consumable tungsten cathode which emits electrons through an arc under the influence of an electric field in the direction of an anode. The anode normally contains the material to be melted. The concentration of electrons at the anode causes release of heat which is responsible for the generation of high temperatures. This is taught in Campbell and Sherwood, "High Temperature Materials and Technology", John Wiley & Sons, New York (1967).

Various modifications of an arc furnace have been suggested to permit manufacture of small castings, for example, by allowing molten metal to flow into a split copper mold, see Hepworth, M. T., Journal of Metals, volume 14, page 411 (1962) and Crow, J. E. and Sweedler, A. R. Review of Scientific Instruments, volume 44, page 1398 (1973). However, copper molds are relatively expensive and in many applications, such as for the manufacture of dental castings, would be uneconomical since a special mold is needed for each individual dental casting.

For this reason, the "lost wax" or "investment" technique is normally used for the manufacture of dental castings. In this process, metal is cast into a mold of gypsum or other ceramic material which is preheated to about 1500° F. (815° C.) at the time the metal is cast. Typically, the hot mold is heated in a furnace from which it must be removed for placement in a casting machine. This transfer must occur quickly, preferably in less than one minute, so that the mold temperature will not decrease significantly before the casting process begins.

Various patents suggest other melting and casting processes for the manufacture of dental castings. Thus, Emerick, in U.S. Pat. No. 4,150,707, teaches the use of an arc furnace which melts material placed in a metal crucible having a central bottom opening. An investment cavity is positioned beneath this crucible opening for receipt of the liquid metal upon melting thereof by the arc furnace. Emerick's relatively small metallic crucible is well-suited for melting gold alloys but would not be adequate for melting reactive metals having significantly higher melting temperatures such as titanium since such metals would be contaminated by reactions with the crucible.

Schultheiss, in U.S. Pat. No. 3,955,612, discloses a device for melting metals in a closed gas pressurizable crucible. The contents of the crucible are heated by an induction melting process. The crucible is arranged on top of a molding cell which is connected by a valve controlled tapping passage from the crucible to the cell. The melt is tapped under pressure into an evacuated mold. A center tap hole in the crucible is opened and closed by means of a central rod which projects down through the crucible and the molten metal and fits into the central passage. The crucible and central rod, while suitable for melting gold alloys, are not adequate for melting more reactive metals, such as titanium, which would attack both the rod and the crucible.

Ida et al in IADR Abstract No. 397 from the 1980 IADR meeting discloses a dental casting machine known by the tradename CASTMATIC which was used for the casting of titanium and titanium alloy castings. The CASTMATIC machine uses a graphite crucible which purportedly is non-reactive with the cast material. However, reactions between graphite crucibles and molten titanium have been described by A. D. and M. K. McQuillan "Titanium", Buttersworth Scientific Publications—London, pages 70–72 (1956). The substitution of cooled copper crucibles would eliminate problems of contamination, but the copper must be adequately cooled and Ida indicates no provision for such cooling in his design.

The present invention contemplates improved melting and investment casting of such reactive and refractory metals particularly for dental castings.

SUMMARY OF THE INVENTION

Briefly, the present invention comprises an improved electric arc furnace and investment casting apparatus. An arc furnace is arranged vertically above an investment casting chamber. The arc furnace includes a non-consumable cathode projecting into a vacuum melting chamber and over a crucible defined in the bottom platform of the melting chamber. The crucible includes a central passage which leads into the vacuum casting chamber. The vacuum casting chamber includes a removable floor which can receive a removable hot mold and can position and hold the hot mold under the crucible passage. An optional valve in the crucible passage may be utilized.

Thus, it is an object of the invention to provide an improved arc furnace and investment casting apparatus.

A further object of the present invention is to provide an improved casting apparatus which is adapted to utilize hot ceramic molds for the manufacture of castings such as dental castings.

Still a further object of the invention is to provide an arc furnace utilizing a relatively cold and, therefore, inert copper crucible which is comprised of a generally planar plate having a bore partially therethrough with a passage at the center of the bore for the flow of melted metal from the crucible to a mold.

Still a further object of the present invention is to provide an arc furnace and investment casting apparatus which is easy to operate, inexpensive and highly efficient.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is a vertical cross section of the improved furnace and casting apparatus of the invention;

FIG. 2 is a side cross sectional view of the crucible of the furnace of the invention illustrating an alternative vacuum seal for the crucible; and FIG. 3 is a side cross sectional view of the mold chamber and mold assembly which illustrates an alternative construction to that shown in FIG. 1.

DESCRIPTION OF THE PREFERRED EMBODIMENT

As shown in FIG. 1, the furnace and casting chamber of the present invention includes an upper arc furnace or melting chamber 10 and a lower casting or mold chamber 12 separated by a copper plate 16. The furnace chamber 10 is formed by a cylindrical furnace wall 14 which is vacuum sealed to the copper plate 16. Plate 16 serves as both the anode and crucible for the furnace. A cover 18 is vacuum sealed to the wall 14.

An electrically insulated tungsten cathode 20 which receives power through a lead (not shown) projects generally along the center line axis of the chamber 10 from the cover 18. The cathode 20 thus projects inwardly toward a counterbore forming a crucible 24 in the copper plate 16.

As shown in FIG. 1, the cathode 20 is comprised of a tungsten electrode which is retained by holder. The electrode 20 is inserted into a counterbore 124 in holder and is retained by set screw 126. An insulating collar 128 is attached to the holder by a set screw 130. The holder thus projects through a bore 132 in the collar 128 and then through a bore 134 in a metal ring 136. The metal ring 136 is threadably secured through an opening 138 in the top cover 18. A rubber O-ring 140 seals the holder with respect to the ring 136 and also insulates the holder from the ring 136. The insulating collar 128 serves to orient the holder with respect to the bores 132, 134. In this manner the electrode 20 is electrically insulated from the chamber and more particularly the chamber walls or cover 18.

Referring again to FIG. 1, a quantity of metal material 26 such as titanium or titanium alloy may be placed in the crucible 24 for melting. At the bottom surface of the crucible 24, a passage 30 is drilled through the plate 16 to the bottom side of that plate 16.

A gas inlet port 32 is provided in the furnace chamber wall 14 and a vacuum or exhaust port 34 is also provided in the chamber wall 14. In this way, vacuum may be effected in the chamber 10 through the port 34. Purging gases such as helium or argon may then be introduced through the port 32 or, alternatively, both functions may be effected using a single port.

The mold chamber 12 is positioned directly beneath the crucible 24 and is attached to the plate 16. Thus, the mold chamber 12 is formed by a cylindrical wall 36 which is vacuum sealed to the lower surface 38 of the wall 16 by means of fasteners 40. The side wall 36 includes a lower flange 42 with a number of slots therein for receiving support bolts 44 which project downwardly through openings 46 in a lower cover plate 48. Wing nuts 50 retain the cover plate 48 in position. The cover plate 48 may be retained in position to support a hot mold 52, e.g. a gypsum or other refractory mold form, therein for purposes of investment casting. The mold 52 is positioned directly below the passage 30. The mold chamber 12 is sealed and also includes inlet port 37 and exhaust or vacuum port 39 for introducing or withdrawing gas from the chamber 12.

FIG. 3 illustrates an alternative construction of the mold chamber and assembly. Referring to FIG. 3, a ceramic mold 52 is retained within a metal casting ring 180. The ring 180 is received by a metal cup 182 which has a central passage or bore 184. A spring assembly 186 is supported on the bottom cover plate 48. The spring assembly 186 is biased against the metal cup 182 and forces the metal cup 182 upward. Thus, spring 188 is a compression spring fitted between a support stand 190 and properly aligned by guide ring 192 so that it will engage the metal cup 182.

A gasket such as a nickel metal or a ceramic gasket 194 is formed in an annular shape and positioned on the top of the metal casting ring 180 against the bottom of the plate 16. The ceramic mold 52 may thus be appropriately positioned beneath the passage 30 for receipt of metal into the mold 52. In this manner the mold 52 is sealed and adapted to easily receive molten metal through the passage 30. Alternatively, the spring 188 may be replaced by a screw mechanism which is operated externally of the plate 48 to thereby advance the ceramic mold 52 into position adjacent or below the passage 30.

Again referring to FIG. 1, a lever arm 54 fits through a sealed opening 56 in the wall 36. The lever arm 54 includes a valve member 58 at its interior end which is adapted to engage a tapered, frusto conical opening 60 in passage 30 and thereby seal the passage 30. The outside of the lever arm 54 may be manually actuated to position the valve member 58 into or out of the passage opening 60. In this manner the inert gas in the furnace chamber 10 can be retained until the casting process begins. Thus, the atmosphere in the mold chamber 12 can be maintained with a different pressure or composition from that in the melting chamber 10.

Referring now to FIG. 2, an alternative to the lever arm 54 and valve member 58 is illustrated. Specifically, the plate 16 includes a series of threaded screw receiving passages 160 circumferentially arranged around the passage 30 and more particularly the frusto conical opening 60. A disc of metal foil material such as aluminum foil 162 is retained on the bottom surface of the plate 16 by means of an annular plate 164 which is secured to the plate 16 by fasteners 166. The plate 164 thus includes a passage 168. The plate 164 seals the foil 162 tightly against the plate 16 to provide a vacuum tight seal.

During the casting operation, molten metal flowing from the crucible 24 through the passage 60 will melt the thin foil 162 and flow into the mold. The foil 162 thus permits differential pressures between the chambers 10 and 12 as well as maintenance of different gases in the chambers 10 and 12.

The crucible plate 16 is a copper plate which may be somewhat thicker than the copper crucible plate 16 associated with prior art arc furnaces since additional mass may be desired to dissipate the heat of melting. Alternatively, the copper crucible may contain an internal chamber for water cooling. As illustrated in FIG. 1, cooling water may be pumped into an internal cooling chamber 200 in the plate 16 through inlet port 201, and then exit through an outlet port. The plate not only serves as the crucible 24, but also defines a wall in each chamber 10, 12.

In operation, when the mold 52 is in place and the chambers are properly purged, an arc is established in the usual manner. The operator will generally set the arc current to heat the sample 26 to a temperature just below the melting temperature. When he is ready to cast the metal, the arc current can be increased to melt the sample 26 and permit it to flow through the passage 30 into the mold 52.

In a typical casting operation, the first step is to open the melting chamber 10 and place the metal 26 to be melted in the crucible 24. The chamber is then closed and sealed against the bottom plate 16. The valve 58 is closed and the chamber 10 is evacuated using vacuum techniques. The chamber 10 is then flushed with an inert gas, for example, a mixture of argon and helium. The purging steps may be repeated.

A hot investment mold 52 is then placed on the cover 48 and the cover 48 is fastened into position by use of the wing nuts 50. The chamber 12 is then sealed, evacuated and also flushed with an inert gas mixture. Next an arc to the metal 26 is initiated at a power level sufficient to melt the sample except for the very lower portion thereof over the opening 30. The valve 58 may then be removed from the casting opening 60. Immediately thereafter the arc current is increased to melt the metal and cause it to flow down through the opening 30 and into the mold 52. The mold 52 is allowed to partially cool within the chamber 12. It is then removed so that the casting may be retrieved.

The present invention is especially useful for the manufacture of dental castings, particularly dental castings made from reactive, high-temperature metals or alloys such as titanium or titanium alloys. While there has been set forth a preferred embodiment of the invention, it is to be understood that the invention is to be limited only by the following claims and their equivalents.

What is claimed is:

1. An improved arc furnace and investment casting apparatus capable of melting and casting small quantities of reactive or refractory metals such as titanium comprising, in combination:

(a) an arc furnace, vacuum sealed melting chamber for maintaining an inert gas atmosphere including a readily removable internally cooled inert material bottom enclosure wall as an anode, a metal crucible integrally defined in the internally cooled inert bottom wall, said crucible positioned substantially at the middle of the bottom wall;

(b) a non-consumable cathode projecting into the melting chamber over the metal crucible;

(c) means for providing power to the cathode and the anode to melt the crucible contents;

(d) a passage through the bottom wall from the metal crucible;

(e) a vacuum sealed casting chamber, for maintaining a vacuum, suspended from the bottom wall beneath the crucible passage, said casting chamber including a removable bottom cover for access to the interior of the casting chamber;

(f) a removable hot mold assemby within the casting chamber including an opening to the mold position below the crucible passage;

(g) a meltable vacuum sealing foil valve in the casting chamber at the bottom of the crucible passage;

(h) means for evacuating each chamber; and (i) means for purging each chamber with inert gas.

2. The apparatus of claim 1 wherein said vacuum casting chamber comprises a chamber side wall surrounding the outlet of the crucible passage and said cover comprises a removable planar plate vacuum sealed to the lower edge of the chamber side wall.

3. The apparatus of claim 1 wherein the inert material bottom enclosure wall of the melting chamber and the metal crucible are integrally formed of a single copper plate.

* * * * *